US005121682A

United States Patent [19]

Parker et al.

[11] Patent Number: 5,121,682

[45] Date of Patent: Jun. 16, 1992

[54] TWIST TIE FEED DEVICE

[75] Inventors: Alexander L. Parker, Tenafly; Fredric Cody, New Providence, both of N.J.

[73] Assignees: Clements Industries, Inc.; Ben Clements & Sons, Inc., both of South Hackensack, N.J.

[21] Appl. No.: 532,006

[22] Filed: Jun. 1, 1990

[51] Int. Cl.[5] ..... B65B 13/28

[52] U.S. Cl. ..... 100/26; 53/138.8; 53/589; 100/31; 100/32; 140/93.6

[58] Field of Search ..... 100/8, 25, 26, 29, 31, 100/32; 140/93 A, 93.6; 53/138 A, 583, 589, 138.6, 138.7, 138.8

[56] References Cited

U.S. PATENT DOCUMENTS

| | | | |
|---|---|---|---|
| 1,357,883 | 11/1920 | McChesney | 100/31 X |
| 3,306,184 | 2/1967 | Hanau | 100/31 X |
| 3,318,230 | 5/1967 | Hilton | 100/31 X |
| 3,428,096 | 2/1969 | Krylov et al. | 100/12 X |
| 3,470,813 | 10/1969 | Nömm et al. | 100/31 X |
| 3,518,807 | 7/1970 | Pitkanen | 53/138.8 X |
| 3,898,924 | 8/1975 | Mead et al. | 100/31 X |
| 4,054,160 | 10/1977 | Knudsen | 100/10 X |
| 4,177,842 | 12/1979 | Dilley | 100/26 X |
| 4,252,157 | 2/1981 | Ohnishi | 100/31 X |
| 4,559,977 | 12/1985 | Dilley | 100/31 X |
| 4,655,264 | 4/1987 | Dilley | 100/31 X |
| 4,827,991 | 5/1989 | Jacobsen et al. | 100/32 X |

*Primary Examiner*—Harvey C. Hornsby
*Assistant Examiner*—Stephen F. Gerrity
*Attorney, Agent, or Firm*—Blum Kaplan

[57] ABSTRACT

A twist tie feed device is provided for twisting together the ends of a tie ribbon which encircles a product including a base plate. A twist head assembly is mounted on the base plate and receives a first end of a tie ribbon which encircles the product and a second end of the encircling tie ribbon and will rotate about itself to twist the tie ribbon about the article. Two positive drive wheels feed the ribbon in one of a first direction towards the twist head assembly and a second direction away from the twist head assembly so that the wheels contact the ribbon at its top and bottom to apply a positive drive force to the drive ribbon as it passes between the drive wheels. A drive assembly is operatively coupled to the twist head assembly and the drive wheels for driving the positive drive wheels and twist head assembly.

31 Claims, 8 Drawing Sheets

FIG. 1
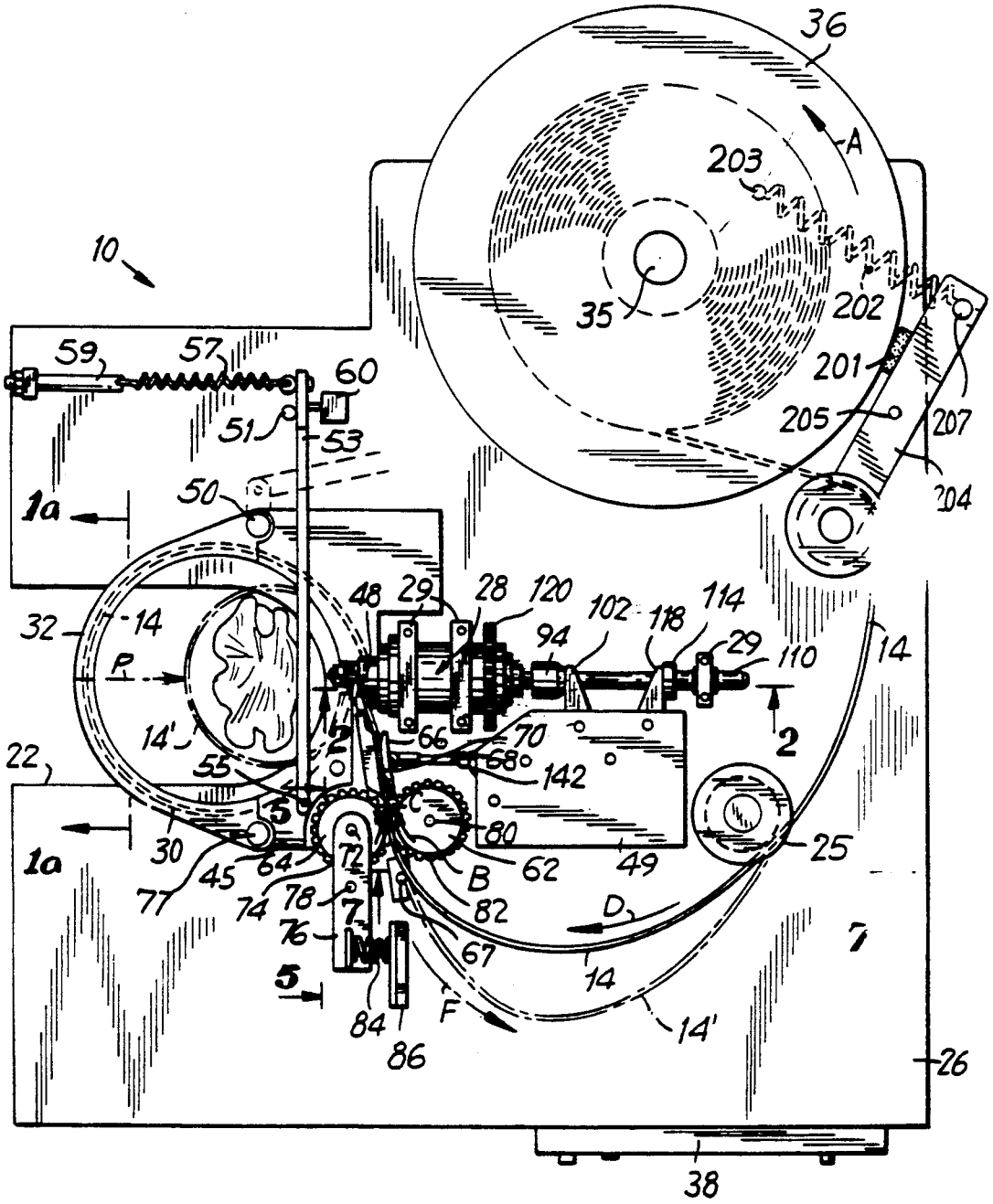
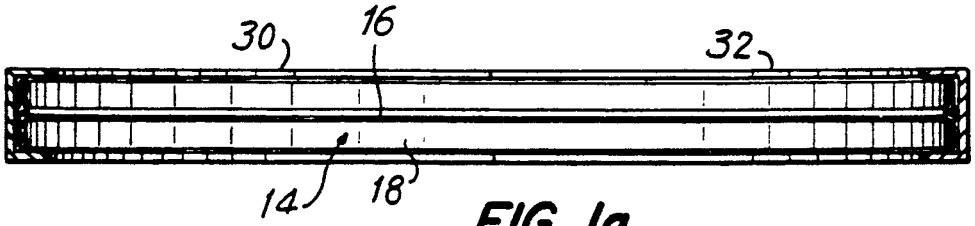
FIG. 1a

FIG. 5
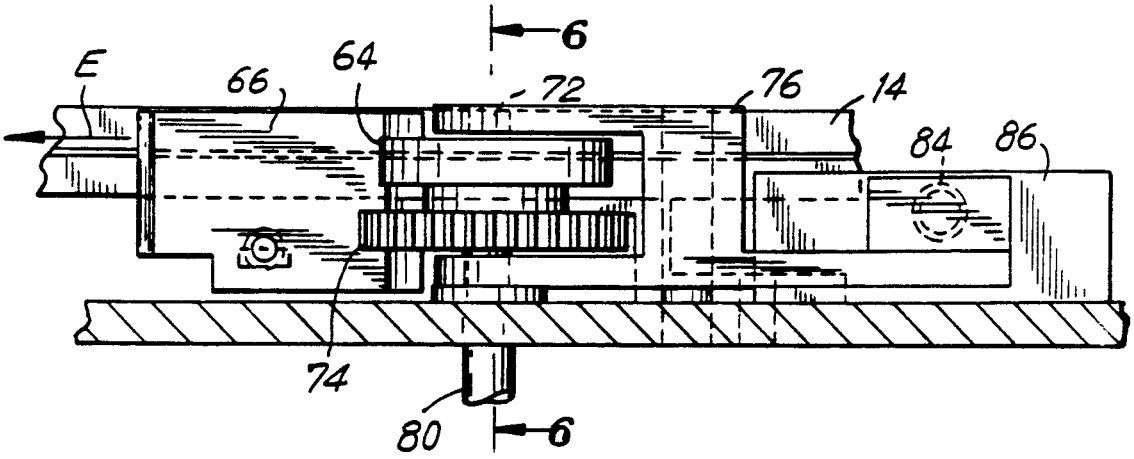
FIG. 6
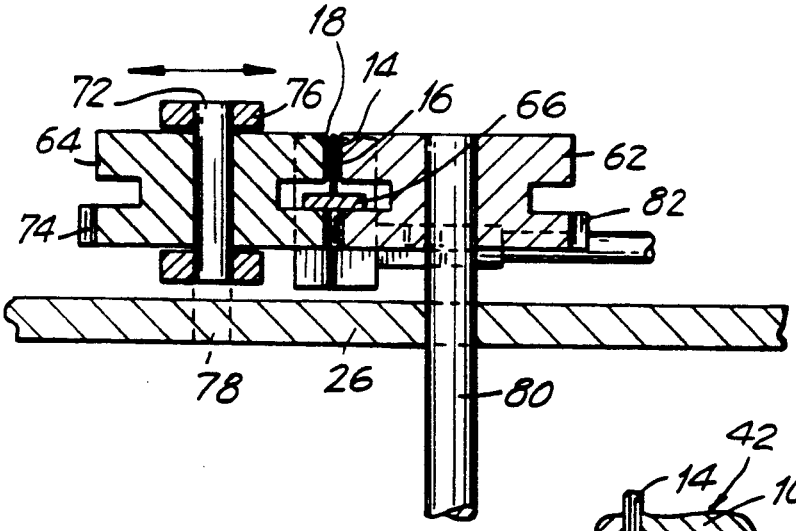
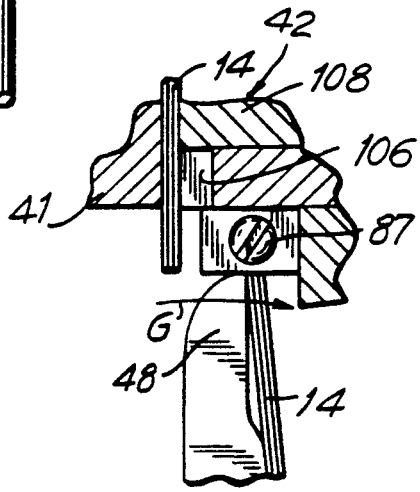
FIG. 6a

TWIST TIE FEED DEVICE

BACKGROUND OF THE INVENTION

This invention relates generally to a twist tie feed device as used for tying a group or bundle of items. For example, celery, asparagus, broccoli and the like, and more particularly to a twist tie feed device utilizing an electric drive and simple gearing operation.

Prior art patents teach the development of machines which effectively apply a tie wire about products to protect those products in transit prior to retail sale. The tie is a malleable wire sandwiched between two strips of paper secured together, for example with adhesive, to form a flat ribbon. The ribbon may also consist of plastic ribbon having a narrow center stripe of greater height than the adjoining areas. After a snug loop of ribbon is formed around the product, the ends of the ribbon are clamped. These clamped ends are then rotated about a central axis producing a permanent twist in the tie ribbon whereby the loop and product are held together. In the known manner, the ribbon can be untwisted by the purchaser of the product and retwisted when it is desired to re-apply the ribbon. These procedures have become most familiar to consumers, with twist ties being used on many products, not only to hold the above mentioned products together, but to provide closure for paper and plastic bags containing foodstuffs and other items and in larger sized bags used for containing potatoes, onions, etc.

Many operational steps are required to apply a twist tie in the form of a wire/paper ribbon. In the past, complex machinery has been designed to effect performance. These machines as illustrated for examples, in U.S. Pat. No. 3,318,230 issued May 9, 1967; 3,428,096 issued Feb. 18, 1969; 3,898,924 issued Aug. 12, 1975 and U.S. Pat. No. 4,177,842 issued Dec. 11, 1979, are machine constructions relying on complex mechanisms, electrically driven in some instances, and generally using cam devices to provide sequential motions necessary to the procedural steps in applying a twist tie ribbon to the product. Each progressive patent teaches an improvement in performance and simplification in structure, however, endless belt chain drives, pulleys, complicated linkage systems are not uncommon and the need for adjustment for operation and to compensate for temperature variation and for wear is relatively frequent. Use of both a forward feed drive for the ribbon and also an independent reverse feed drive for tightening the ribbon about the bundle is also disclosed in the prior art, adding to complexity.

It is also known from U.S. Pat. No. 4,559,977 issued on Dec. 24, 1985 to provide a pneumatic twist tie feed device for providing a helical wrap about the package. This device utilizes a first gripper which clamps and retains the free end of the ribbon against a second gripper. Pressure rollers operate in reverse retracting excess ribbon about the produce. A friction clutch, operative only for reverse ribbon feeding, allows for ribbon slippage as the ribbon tightens around the produce. Then the second gripper clamps the other end of the ribbon against the twister head and a twister mechanism rotates the clamped ends of the ribbon about a common axis twisting the ribbon ends together. Axial gripper motion is provided by cylindrical valves having pistons concentric with and supported by a gripper support rod tube and acting, respectively at the ends of the gripper supports away from the tie ribbon. A rack and pinion mechanism is used to provide rotation of twister mechanism and forward and reverse feeding of the ribbon. All components are pneumatically driven.

This prior art device was satisfactory. However, it also was overly complex requiring the simultaneous control of several pneumatic valves and solenoids. Additionally, because the ring was a helical ring, if the helical wrap became shifted to be perpendicular to the bundle, the wrap became loose. Additionally, only a single forward drive wheel was utilized in conjunction with an idler so that during reverse driving, the idler must be removed from contact with the ribbon, while an accumulator rod was utilized to pull and tension the ribbon in a backward feeding direction.

What is needed is a twist tying machine which is simple and reliable in construction, and reduces the total number of parts, which provides a circular wrap and may perform wrapping without the use of an accumulator.

SUMMARY OF THE INVENTION

Generally speaking, in accordance with the invention, a twist tie feed device especially suitable for tying bundles is provided. When produce or the like is placed on a work table at the preferred position, a ring encircles the bundle and the tie ribbon is fed by two positive drive rollers acting in tandem around the inner periphery of the ring to form a complete loop. Then a first gripper clamps and retains the free end of the ribbon encircling the product. The positive drive rollers are driven in a reverse direction to extract excess ribbon from the ring and provide a snug fit for the ribbon about the produce. A sensor determines the tightness of the ribbon wrapped around the bundle and causes the rollers to stop feeding in a reverse direction once a predetermined tightness is present, thus preventing damage to the produce. Then the second gripper clamps the other attached end of the ribbon such that both ends of the ribbon are now constrained. A knife severs the engaged ribbon from the ribbon supply as the second gripper clamps the other attached end of the ribbon. A twister mechanism rotates the clamped ends of the ribbon about a central axis so that the wire within the ribbon is twisted and the ribbon ends are joined together in the process of twisting.

The ring forms a concentric circle about the bundle so that the ribbon is pulled about the bundle perpendicular thereto. The grippers and twister mechanism includes a collar, the first gripper being slidably mounted within a cylinder. The second gripper is also slidably mounted in a cylinder concentric and parallel to the first gripper so that when the tie ribbon is held by the first gripper and second gripper the two ends of the tie ribbon overlap each other. The ribbon is fed through a feed chute having a knife at one end. A gearing mechanism is coupled to the first gripper and second gripper and feed chute so that by the rotation of the gears in a complete circle the first gripper and second gripper are opened and then sequentially closed. The feed chute is moved during the closing of the second gripper causing the knife to cut the ribbon through shearing. When both grippers are closed, the entire cylinder is rotated a predetermined number of times to twist the ribbon about the bundle. A programmed logic control is provided to control the amount of ribbon which is fed through the twist tie device, the rotating of the gears, the driving of the positive drive wheels and the rotation of the cylinder.

Accordingly, it is an object of the invention to provide an improved twist tying machine which is simple and reliable in operation.

Another object of this invention is to provide an improved twist tying machine which has a minimum number of parts, is simple to construct and requires little maintenance.

A further object of this invention is to provide an improved twist tie device which allows for adjustments in the pressure placed on the bundle by the tie ribbon.

Yet another object of the invention is to provide an improved twist tie device which allows for extracting excess ribbon and forward feeding of the ribbon during tying without the use of an accumulator.

A further object of this invention is to provide an improved twist tie feed device which provides a tied bundle having the ribbon fastened perpendicularly about the bundle.

Still other objects and advantages of the invention will in part be obvious and will in part be apparent from the specification.

The invention accordingly comprises the features of construction, combination of elements, and arrangement of parts which will be exemplified by the constructions hereinafter set forth and the scope of the invention will indicated in the claims.

BRIEF DESCRIPTION OF THE DRAWINGS

For a fuller understanding of the invention, reference is had to the following description taken in connection with the accompanying drawings, in which:

FIG. 1 is a top plan view of a twist tie feed device constructed in accordance with the invention;

FIG. 1*a* is an enlarged sectional view taken along line 1*a*—1*a* of FIG. 1;

FIG. 5 is a sectional view showing a positive drive wheel for feeding the ribbon through the twist tie feed apparatus taken along line 5—5 of FIG. 1;

FIG. 6 is a sectional view taken along line 6—6 of FIG. 5;

FIG. 6*a* is an enlarged view of a knife mechanism constructed in accordance with the invention;

DETAILED DESCRIPTION OF THE PREFERRED EMBODIMENTS

Figure 2:
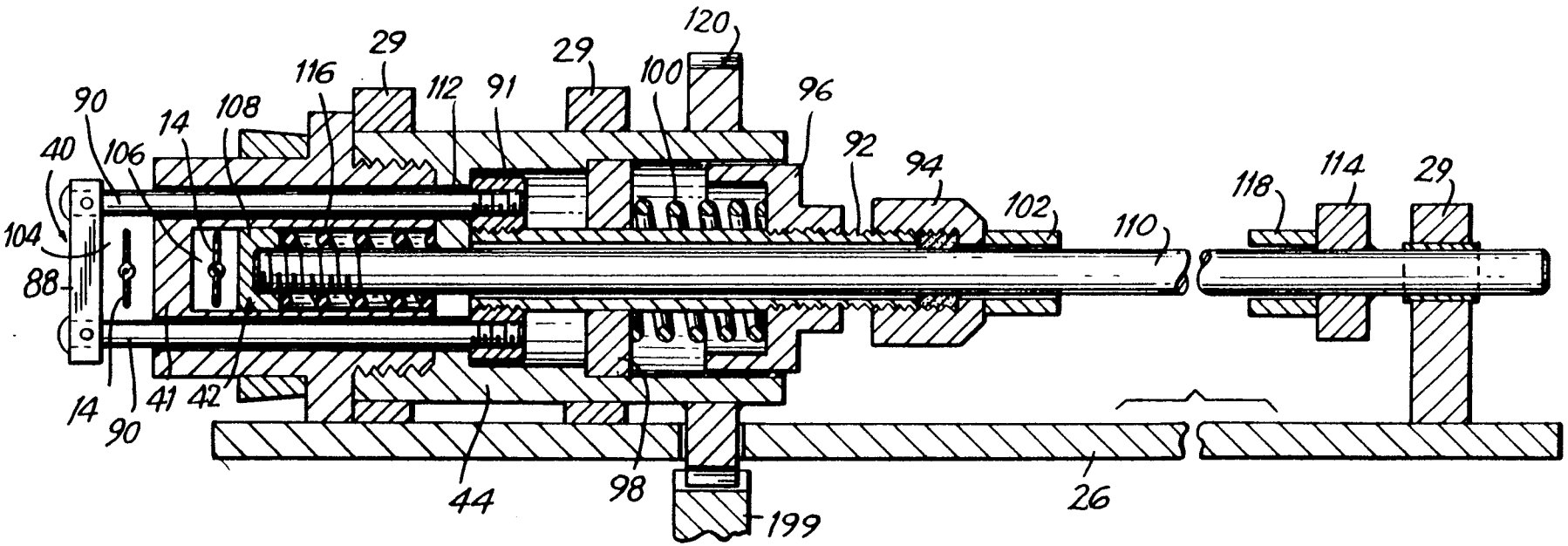
FIG. 2 is a sectional view of a twist head assembly constructed in accordance with the invention.

Operation of the twist tying feed device 10 in accordance with the invention is generally known from the above cited patents which are incorporated herein by reference. In particular, a product 12 (FIGS. 8, 10), for example, a bundle of asparagus stalks, a bunch of celery, a rolled-up newspaper, a bag or the like is held together by a tie ribbon 14 which consists of a strand of wire 16 (FIGS. 1*a*, 6) sandwiched between two flat paper strips 18 which are adhesively joined together. The paper strips may be replaced with thin plastic strips joined together or, the entire tie ribbon 14 may be formed of a single plastic strip of varying widths. A length of tie ribbon 14 encircles the product 12 and the wire is twisted as at 20. Because the wire is malleable and takes a set when twisted the product 12 remains encircled until the tie ribbon 14 is untwisted by the product customer.

Figure 8:
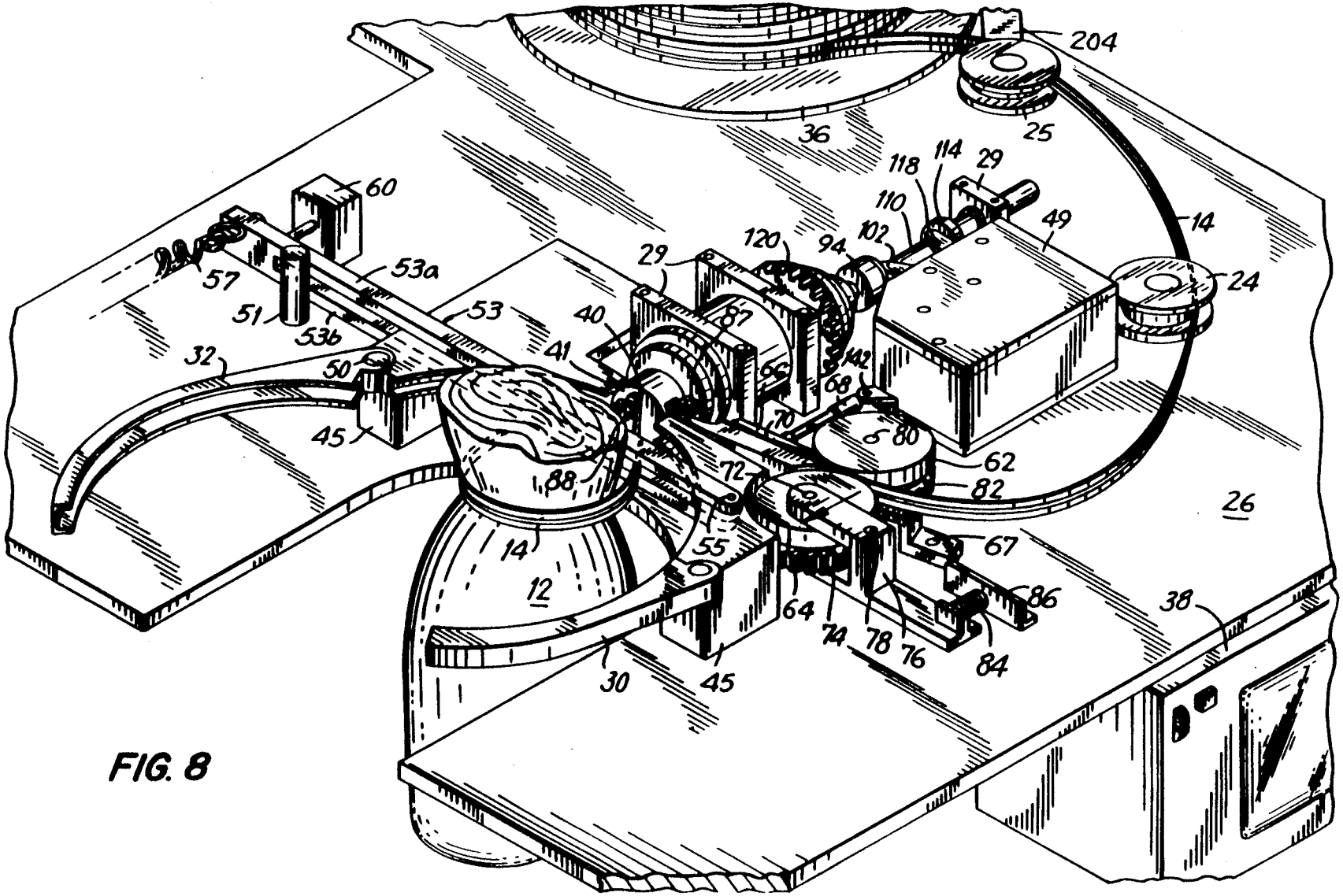
FIG. 8 is a perspective view showing the operation of the twist tie feed device just prior to twisting in accordance with the invention.

With reference to FIGS. 1, 2 and 8 twist tie feed device 10 in accordance with the invention comprises a base plate 26. A head assembly 28 is mounted to base plate 26 by three mounting brackets 29 which also serve as bearings for the rotation of cylinder 44 as described below.

The head assembly 28 includes a second ring 30 and an first ring 32. As in the prior art, the product 12 to be tied is positioned in a slot 22 formed within base plate 26 extending to mounting head assembly 28 and is positioned adjacent head assembly 28. First ring 32 is pivoted towards ring 30 to encircle product 12 (as shown in phantom in FIG. 9), forming by connection with second ring 30, a single continuous circular loop. Both first ring 32 and second ring 30 include an inner guide channel 34 dimensioned to continuously guide tie ribbon 14 around the ring. Tie ribbon 14 enters head assembly 28, as described more fully and hereinafter, and moves around first ring 32 in channel 34 and passes through second ring 30 to complete a circular loop about the product 12. Because tie ribbon 14 is stiff yet mallable, guide channel 34 guides ribbon 14 about the ring as tie ribbon 14 is fed.

Tie ribbon 14 is supplied continuously from a ribbon supply drum 36 mounted to base plate 26 on a shaft 35. As ribbon 14 is drawn about the loop, ribbon supply drum 36 rotates in the direction of arrow A on shaft 35, unwinding ribbon 14 as needed. A braked pulley 24 and guide wheel 25 are mounted on base plate 26 along the travel path of ribbon 14 to guide ribbon 14 towards the ring. A length of ribbon 14 sufficient to follow the inner ring periphery is fed for each item of product. After feeding around channel 34 as described above, first ring 32 and second ring 30 open and a leading end of ribbon 14 is engaged by first gripper 40 (FIG. 2) against a gripper block 41. Then the attached end of the loop of tie ribbon 14 is withdrawn from the ring tightening tie ribbon 14 around the product 12. At that time, the attached end of ribbon 14 is constrained against gripper block 41 by a second gripper 42 and severed from the remaining ribbon 14 by a knife 48. Then a cylinder 44 acting as a twister head within which both grippers 40 and 42 are mounted is rotated while the ends of ribbon 14 are fixedly restrained, twisting the ends of tie ribbon 14 with respect to each other and producing the tie as indicated at 20 in FIG. 10.

Figure 3:
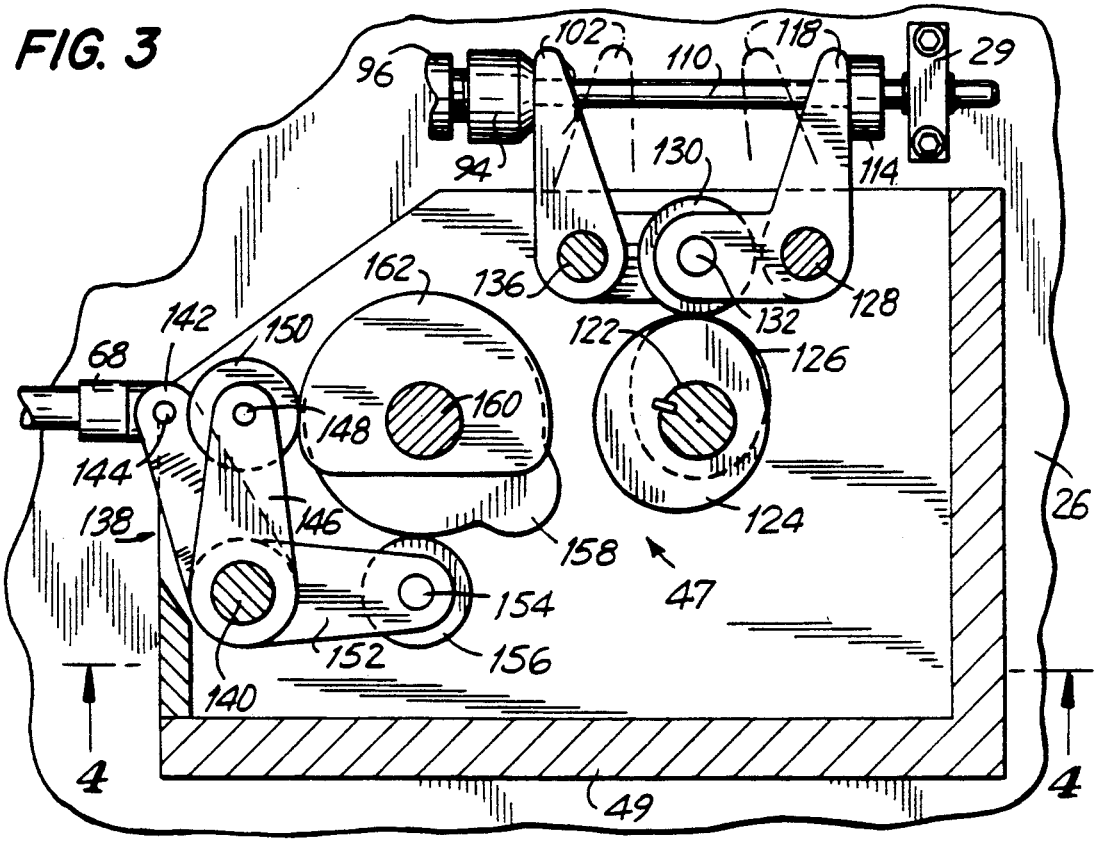
FIG. 3 is a sectional view of the gear mechanism for controlling the head assembly constructed in accordance with the invention.
Figure 4:
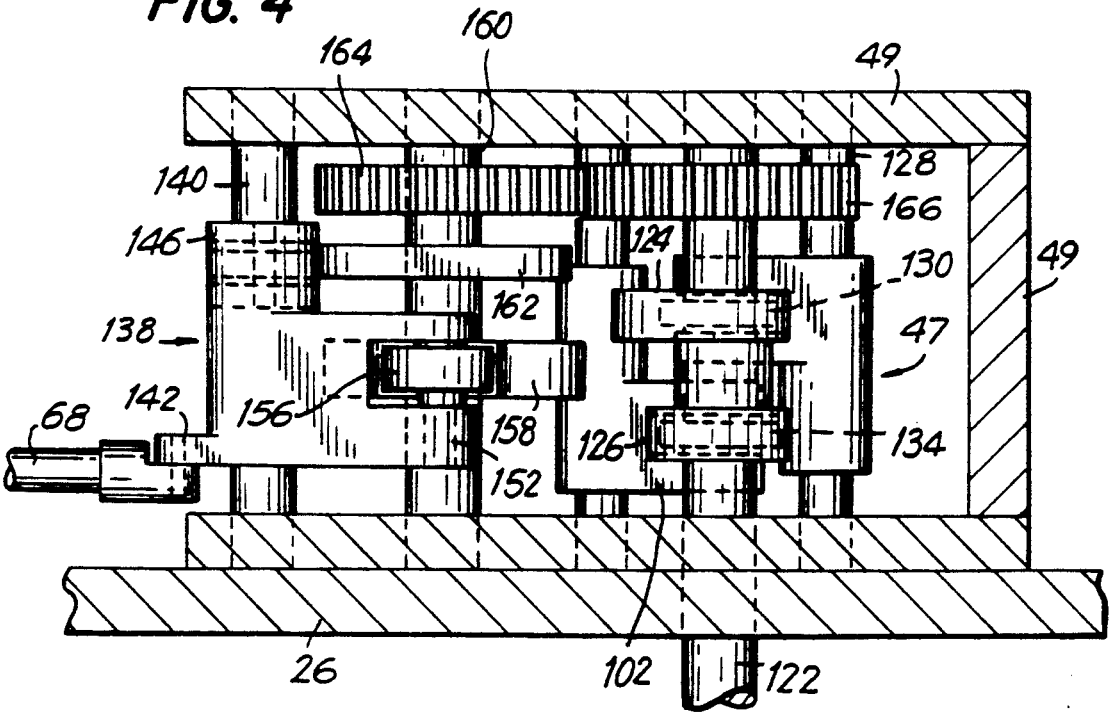
FIG. 4 is a sectional view taken along line 4—4 of FIG. 3.

A gear mechanism 47 (FIG. 3) is mounted in gear box 49 on base plate 26. Gear mechanism 47 causes first gripper 40 and second gripper 41 to close. Simultaneously with the closing of second gripper 42, a knife 48 is caused by gear mechanism 47 to shear ribbon 14 just prior to twisting. The operation may then be repeated on the next product.

It should be noted that base plate 26 is illustrated in a horizontal position by way of example only. The operation to be discussed in detail below may also be performed with base plate 26 in a vertical orientation. Additionally, an enclosure may be provided about base plate 26 such that only the front end of head assembly 28 including the ring is exposed, thereby protecting the moving parts. Lastly, as will be described below, a program logic controller 38 is mounted on base plate 26 to control operation of twist tie feed device 10.

The twist tie feed device 10 in accordance with the invention is now described in greater detail.

CIRCULAR RING

Figures 9, 10:
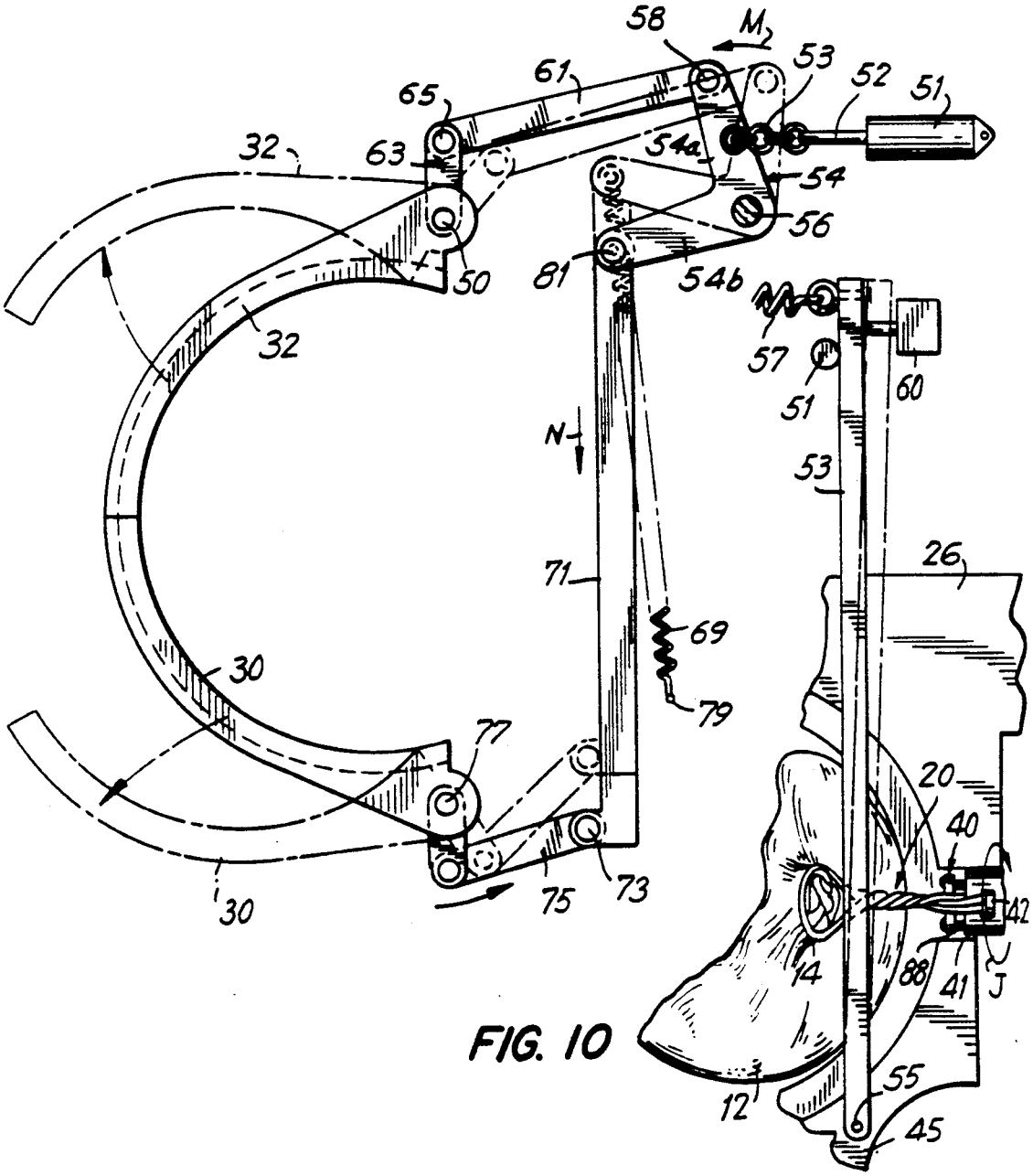
FIG. 9 is a top plan view of the ring controlling mechanism constructed in accordance with the invention.
FIG. 10 is a top plan view illustrating the operation of the device just after twisting in accordance with the invention.

As best illustrated in FIGS. 1, 1*a*, 8 and 9, first ring 32 is pivotably mounted to a block portion 45 and in turn to base plate 26 by means of a pivot pin 50. First ring 32 is fixedly mounted to pivot pin 50 as to rotate with pivot pin 50. Pivot pin 50 extends through base plate 26 (FIG. 9). A DC power solenoid 51 including a rod 52 extending therefrom is mounted on the under side of base plate 26. A V shaped linkage arm 54 is pivotably mounted about a pivot pin 56. Rod 52 of solenoid 51 is coupled to the center of one arm 54*a* of V shaped linkage arm 54 by a chain 53. A second linkage arm 61 is coupled to the same arm 54*a* of linkage arm 54 through a pivot pin 58. At its other end, linkage arm 61 is coupled to a third linkage arm 63 through a pivot pin 65. Linkage arm 63 is coupled to pivot pin 50 so that movement of linkage arm 63 causes rotation of pivot pin 50 rotating first ring 32.

Similarly, second ring 30 is mounted about a pivot pin 77 which extends through base plate 26. A linkage arm 75 is mounted about pivot pin 77 so that movement of linkage arm 75 causes rotation of second ring 30. A cross link 71 is connected at one end by a pivot 73 to linkage arm 75 and at its other arm to the second arm 54*b* of linkage arm 54 by a pivot pin 81. A tension spring 69 is anchored to base plate 26 at a pin 79 at its one end and to pivot 81 at its other end. Movement of cross link 71 causes rotation of first ring 30.

To close the ring, solenoid 51 is deactivated so that spring 69 acts to bias pin 81 towards it. Linkage arm 54 pivots in the direction of arrow M pushing link arm 61 ahead of it causing link arm 63 to rotate towards link arm 61 rotating shaft 50 closing first ring 32 as shown in dark line. At the same time, cross link 71 is moving in the direction of arrow N (FIG. 9) rotating arm 75 in a clockwise direction as viewed in FIG. 9 and rotating pivot 77 in a clockwise direction closing second ring 30.

To open the ring, solenoid 51 is activated drawing rod 52 therein pulling on chain 53. This causes link arm 54 to overcome the force of spring 69 and pivot in the reverse direction. Arm 61 now pulls on arm 63 rotating pivot 50 to open first ring 32. Similarly, cross link 71 is now pulled in the direction opposed to arrow N rotating arm 75 in a counterclockwise direction opening second ring 30. To return the ring to the closed position, solenoid 51 is deactivated and the force of biasing spring 69 rotates link lever 53 as discussed above. When in the closed position first ring 32 joins second ring 30 forming a single guide channel 34 extending on the opposed side of bundle 12 from rings 30, 32 around the inner periphery of the closed ring which is in the form of a circle perpendicular to the product to be placed therein as seen in FIG. 1.

A tension bar 53 consisting of two spaced bars 53*a* and 53*b* is also pivotably mounted to block portion 45 by means of a pivot pin 55, the other end of tension bar 53 being supported and biased in a direction away from head assembly 28 by spring 57. Spring 57 is anchored at one end to tension bar 53 and at a second end to bolt 59 anchored to base plate 26. A peg 51 is positioned on mounting table 21 in the biased pathway of tension bar 53 to prevent tension bar 53 from being moved too far away from first gripper 40. Additionally, a microswitch 60 is disposed on the opposite side of tension bar 53 from peg 51 at a position which allows movement of tension bar 53 to a point which prevents product 12 from engaging directly with grippers 40, 42, preventing damage.

Microswitch 60 is coupled to program logic control 38 ("PLC") which as will be discussed in greater detail below, prevents further tensioning of ribbon 14. Tensioning of ribbon 14 causes bundle 12 to move tension bar 53 in a direction opposite to the biasing force applied by spring 57 until microswitch 60 is triggered causing PLC 38 to stop tensioning of the ribbon. Additionally, during tying ribbon 14 extends between bars 53*a*, 53*b* so that when bundle 12 is tensioned against tension bar 53 it does not twist about bar 53. Accordingly, tension bar 53 not only prevents product 12 being bundled from coming too close to grippers 40, 42, but further provides the function of determining the tension of the ribbon 14 tied about bundle 12 while ensuring a correct straight tie. By holding the product apart from the twisting mechanism, lengths of tie ribbon 14 are provided to be twisted without crushing the product 12.

THE RIBBON FEED

Tie ribbon 14 is threaded from ribbon supply drum 36 around brake pulley 24, past guide wheel 25 until it reaches positive drive wheels 62, 64 which both drivingly rotate to feed ribbon 14 through a ribbon feed chute 66 formed with a shallow channel 70 through which tie ribbon 14 feeds.

A pivot arm 204 is pivotably mounted about a pivot pin 205 to base plate 26. Brake pulley 24 is rotatably mounted on pivot arm 205 so that tie ribbon 14 drawn about pulley 24 causes pulley 24 to rotate. A brake pad 201 is mounted on pivot arm 204 and stops rotation of supply drum 36 when coming in contact therewith. A spring 202 coupled to a pin 203 below supply drum 36 and a pin 207 on pivot arm 204 biases brake pad 201 towards supply drum 36. When ribbon 14 is first displaced in the direction of arrow D (FIG. 1), the tensioning of tie ribbon 14 causes pulley 24 to be pulled towards supply drum 36 absorbing the initial force of tie ribbon 14. This causes pivot arm 204 to pivot about pivot pin 205 releasing brake pad 201. Ribbon may now be freely taken from supply wheel 306 as supply wheel 306 rotates in the direction of arrow A. The initial movement of pulley 204 allows drive wheels 62, 64 to overcome the initial inertia of supply drum 36. Once forward driving has stopped, and reverse driving has begun, spring 202 now acts to bring brake pad 201 in contact with supply drum 36 stopping the feeding of ribbon 14.

Positive drive wheel 64 is rotatably mounted on a shaft 72 along with a gear 74. Shaft 72 is mounted within a mounting frame 76. Mounting frame 76 is rotatably mounted on base plate 26 about a pivot pin 78. Similarly, positive drive wheel 62 is mounted along with a gear 82 about a shaft 80. A spring 84 is mounted between a mount 86 affixed to base plate 26 and mounting frame 76 to provide a biasing force for rotating mounting frame 76 about pivot pin 78. This causes gear 74 to engage gear 82. Additionally, it brings the surface of wheel 64 in contact with the surface of wheel 62.

A drive shaft 80 is coupled to a drive assembly 200 (FIG. 7) to be described in detail below. Because gear 74 meshes with gear 82, rotation of shaft 80 rotates gear 82 which in turn rotates gear 74. This causes both drive wheel 64 and drive wheel 62 to rotate simultaneously. Sufficient pressure is applied to tie ribbon 14 between drive wheel 62 and drive wheel 64 such that when drive wheels 62, 64 rotate, tie ribbon 14 is fed in the direction of arrow D (FIG. 1) into chute 66 and out of chute 66 in the direction of arrow E. The wheels 62, 64 are synchronously driven in the direction of arrows B, C so there are no shearing forces placed upon ribbon 14.

Figure 11:
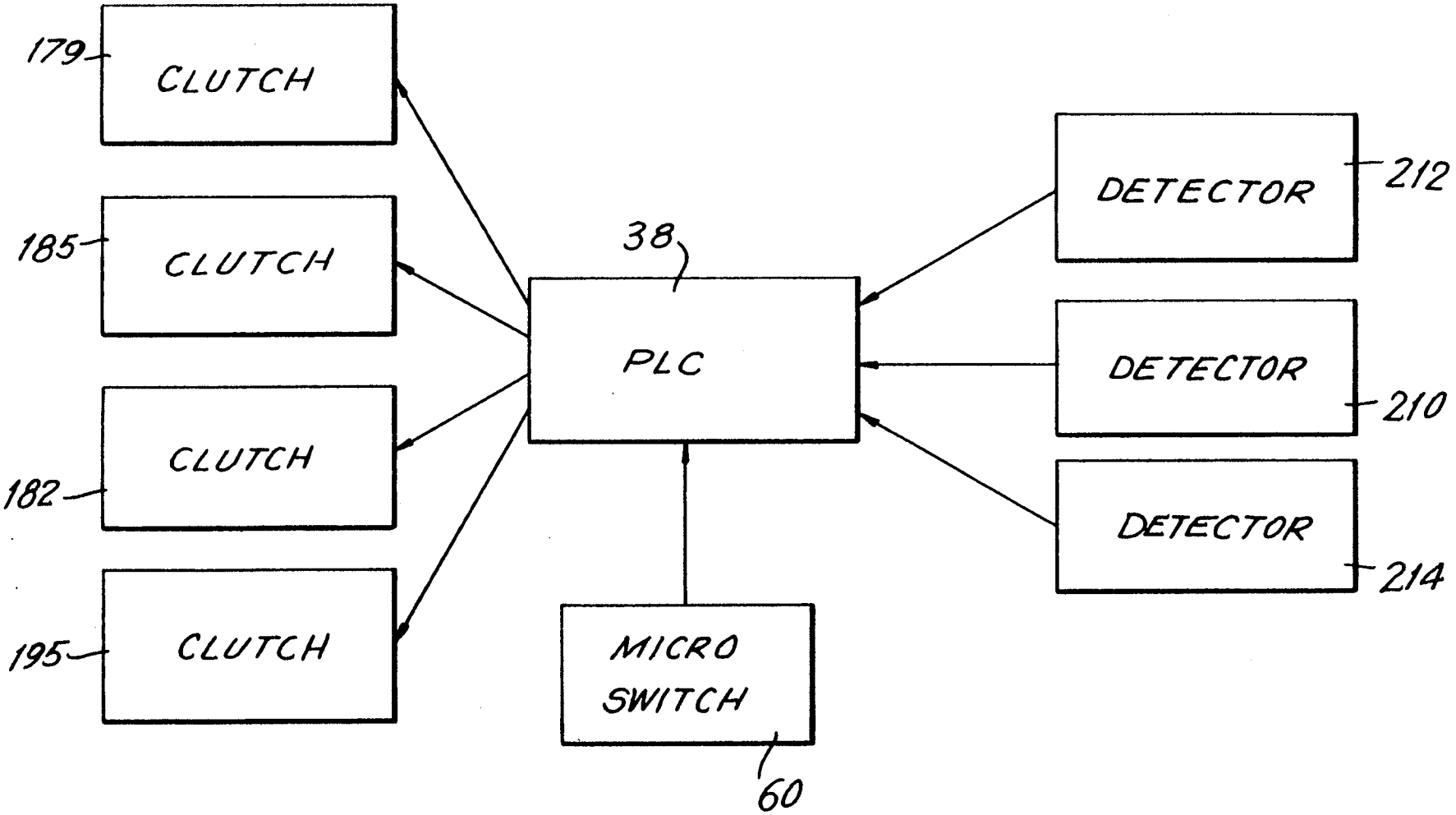
FIG. 11 is a block diagram of the PLC, detectors and clutches as constructed in accordance with the invention.

PLC 38 determines the proper amount of tie ribbon 14 to be fed to complete a circle about the ring by monitoring the number of revolutions of positive drive wheels 62, 64 as detected by a detector 212 (FIG. 11). Detector 212 is well known in the art such as a proximity detector or the like. Once PLC 38 has determined that the proper amount of tie ribbon 14 has been fed, shaft 80 is then rotated in a reverse direction causing ribbon to be fed from chute 66 in the direction of arrow F. Because drive wheels 62, 64 are positive drive wheels, i.e. provide their own feeding energy, and are synchronized through the meshing of gear 74, 82, there is no net slippage between the two wheels as they rotate to provide wear and tear on the tie ribbon 14 as it is fed. Tie ribbon 14 is fed in this opposite direction as is illustrated by tie ribbon 14' until the tensioning of tie ribbon 14 brings the bundle against tension bar 53 with a predetermined tension causing tension bar 53 to overcome the biasing force of spring 57 triggering microswitch 60. This causes PLC 38 to terminate driving of power drive wheels 62, 64.

A knife 48 is positioned at the exit end of ribbon feed chute 66 at one side of channel 70. Ribbon feed chute 66 is pivotably mounted to base plate 26 about a pivot pin 67. Ribbon feed chute 66 is coupled to gear mechanism 47 by a rod 68. As will be discussed in greater detail below, operation of gear mechanism 47 causes ribbon feed chute 66 to move relative to head assembly 28 in a direction indicated by arrow G (FIG. 6*a*) so that knife 48 shears tie ribbon 14 against a block 86 mounted adjacent head assembly 28.

HEAD ASSEMBLY

As indicated earlier, the purpose of head assembly 28 is to encircle a product 12 with a tie ribbon 14, then to draw the tie ribbon 14 snugly about the product and to twist the ends of tie ribbon 14 such that the product 12 is tied, so that the process may be repeated once tie ribbon 14 has been sheared.

As illustrated in FIGS. 1, 2 and 8, head assembly 28 includes a twister head 44 rotatably mounted on base plate 26. A first gripper 40 includes a gripper head 88 mounted on a pair of rods 90 which are slidably mounted within twister head 44. Rods 90 are anchored at their other ends by a ring 91. A hollow tube 92 is threaded within ring 91 and extends without cylinder twist head 44. A collar 94 is threaded and is screwed onto a threaded end of hollow tube 92 which extends from twister head 44.

A wall 98 is provided within cylinder 44. Hollow tube 92 is slidably mounted within wall 98. A plug 96 is slidably mounted within twist head 44 and is affixed to hollow tube 92. A spring 100 is disposed about hollow tube 92 between wall 98 and plug 96 to bias plug 96 away from wall 98. This biasing moves hollow tube 92 and collar 90 out of cylinder 44, moving gripper head 88 towards gripper block 41. A toggle 102 positioned within gear box 49 operates to apply a force against collar 94 forcing collar 94 in the direction to open gripper 40 providing a space 104 between gripper head 88 and gripper block 41.

A slot 106 through which ribbon 14 emanating from ribbon feed chute 66 is threaded is formed between gripper block head 41 and second gripper 42 and is aligned with the guide channel formed within the ring. Second gripper 42 includes a gripper head 108 mounted on a rod 110 extending through a wall 112 within twisting head 44 and through hollow tube 92. Gripper head 108 is slidably positioned within a cavity formed within gripper block 41. Rod 110 is slidably mounted within mounting bracket 29 at its other end. A collar 114 is fixedly mounted on rod 110. A spring 116 is disposed about rod 110 between gripper head 108 and wall 112 to bias gripper head 108 to close slot 106. A second toggle 118 supported within gear 49 and acted upon by gear mechanism 47 moves collar 114 so that gripper head 108 is moved away from gripper head 88 as seen in FIG. 2.

To open grippers 40, 41, gear mechanism 47 drives toggle 102 and 118 away from each other so that collar 94 is moved in a direction away from collar 114. This causes gripper 40 to move away from gripper block 41 providing opening 104. Simultaneously, gripper 42 is pulled away from gripper block 41 opening slot 106. To close grippers 40, 42, toggles 102 and 118 are moved towards each other in the directions of arrows I, K (FIGS. 3, 7) allowing spring 100 to bias plug 96 out of twist head 44 moving gripper 40 towards gripper block 41. Similarly, once toggle 118 is moved away from collar 114, spring 116 biases gripper 42 towards gripper block 41. As will be described below, toggles 102 and 118 act independently of each other allowing gripper 40 to be open or closed independently of gripper 42. Thus, to be explained more fully hereinafter, toggle 102 causes the engagement of the free end of ribbon 14 between first gripper 40 and gripper block 41 and does not release when second gripper 42 is closed. Additionally, it should be noted that slots 104 and 108 are parallel to each other so that sections of ribbon 14 positioned therein directly overlay each other allowing for a circular tie of the bundle.

Figure 7:
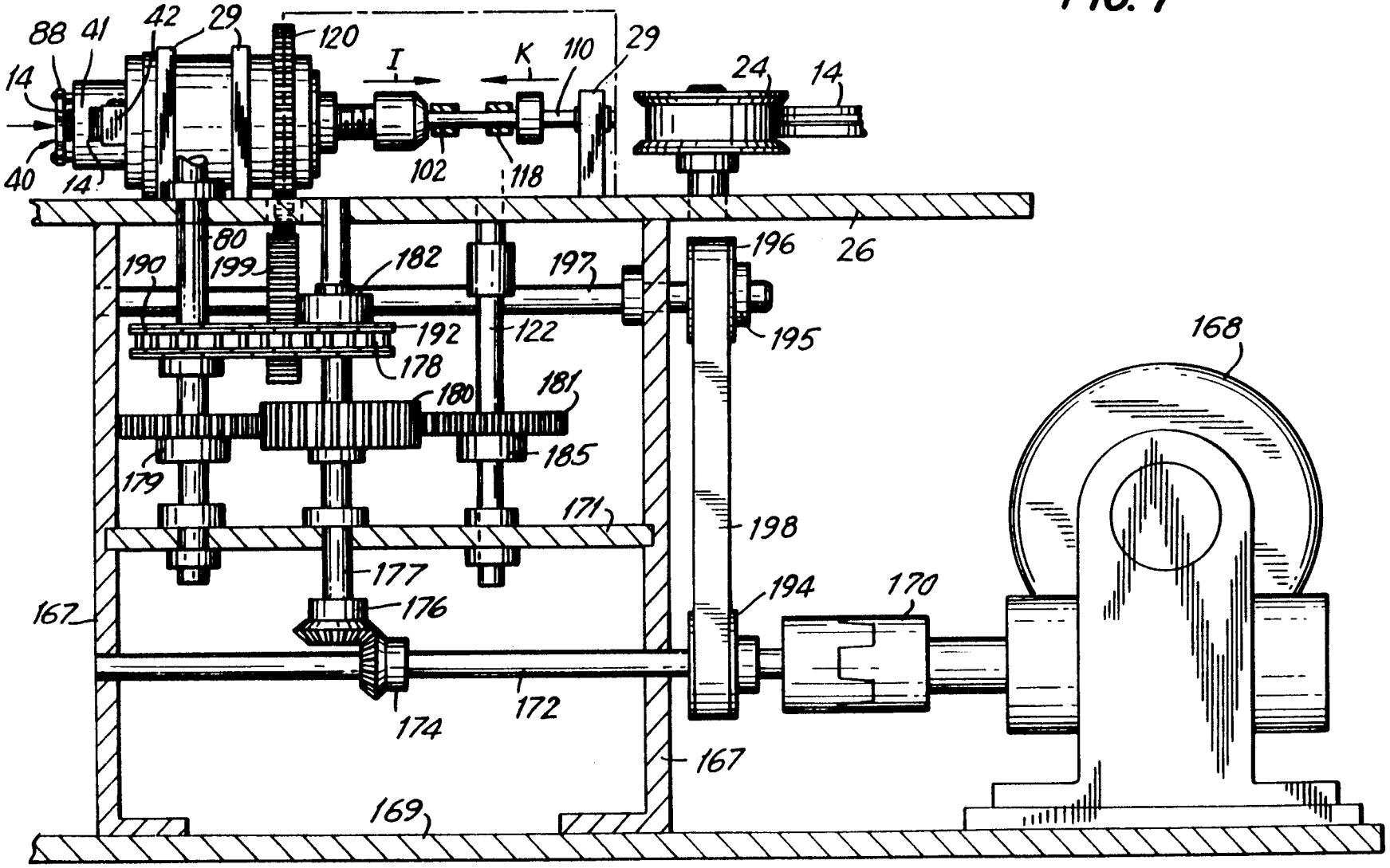
FIG. 7 is a sectional view taken along line 7—7 of FIG. 1 showing the drive assembly for the twist tie feed device constructed in accordance with the invention.

A rotation gear 120 is fixedly secured about cylinder 44. Cylinder 44 is rotatably mounted within mounting brackets 29 and is rotated by the driving of rotation gear 120. Additionally, as seen in FIG. 7 toggles 102, 118 do not bear on collars 94 and 114 (FIG. 7), and there is no excessive force interfering with smooth rotation and twisting. This results in the twisting of tie ribbon 14 as shown at 20 (FIG. 9).

GEAR MECHANISM

As indicated earlier, the purpose of gear mechanism 47 is to control the timing and operation of first gripper 40, second gripper 42 and knife 48. Through the use of a small number of cams, cam followers and a single driving shaft, head assembly 28 and knife 48 are controlled.

Gear mechanism 47 includes a drive shaft 122 rotatably mounted within gear box 49 and extending through base plate 26 to be operatively coupled to drive assembly 200 (FIG. 7). A cam 124 and a cam 126 are mounted on drive shaft 122 so as to rotate with the rotation of drive shaft 122. Toggle 118 has a substantially V-shape and is rotatably supported about a pivot pin 128 at the corner of the V. Pivot pin 128 is mounted within gear box 149. As discussed above, one arm of toggle 118 comes in contact with collar 114. The other arm of toggle 118 has a pin 132 disposed therein which rotatably supports a cam follower 130. Cam follower 130 operatively contacts cam 124 so that rotation of cam 124 causes toggle 118 to rotate about pivot pin 128 between the positions shown in phantom and dark line of FIG. 3. Accordingly, the rotation of cam 124 causes the opening and closing of second gripper 42.

Similarly, toggle 102 is also shaped as a V and is rotatably supported about a pivot pin 136 at the corner of the V. Pivot pin 136 is also mounted within gear box 49. One arm of toggle 102 contacts collar 94 while the other arm of toggle 102 supports a cam follower 134 supported thereon. Cam follower 134 follows cam 126 as it rotates causing toggle 102 to move between the position shown in dark line and phantom in FIG. 3. Accordingly, the rotation of cam 126 causes toggle 102 to control the opening and closing of first gripper 40.

As indicated earlier, the movement of ribbon feed chute 66 about a pivot 67 to cause shearing of ribbon 14 by knife 48 is also controlled by gear mechanism 47. Rod 68 is connected to ribbon feed chute 66 at its one end and to a three arm lever 138 at its other end. Three arm lever 138 is rotatably mounted within gear box 49 about a shaft 140. Rod 68 is coupled to a first arm 144 of three arm lever 138 about a pivot pin 142. A second arm 146 of three arm lever 138 contains a pin 148 disposed therein. A cam follower 150 is rotatably mounted about pin 148. A third arm 152 extending substantially perpendicularly relative to second arm 146 also contains a pin 154 about which a cam follower 156 is rotatably supported. Rotation of three arm lever 138 causes rod 68 to move back and forth moving knife 48 in the direction of arrow G (FIG. 6*a*).

To move lever 138, a first cam 158 and a second cam 162 are mounted upon a shaft 160 which is rotatably mounted within gear box 49. Cam follower 150 follows the periphery of cam 162, while cam follower 156 follows the periphery of cam 158.

A gear 164 is mounted on shaft 160 and rotates therewith. A second gear 166 mounted on drive shaft 122 rotates with drive shaft 122 and meshes with gear 164. This causes rotation of cams 158, 160. Accordingly, knife 48 works in conjunction with head assembly 28 As shaft 160 rotates, cam 158 acts on cam follower 156 pushing cam follower 156 away from shaft 160. This causes three arm lever 138 to rotate about pivot pin 140 moving rod 68 causing knife 48 to move in the direction of arrow G. As shaft 60 continues to rotate, cam 162 acts on cam follower 150 to rotate three arm lever 138 about pivot pin 140 in a reverse direction. This returns rod 68 to its previous position which in turn returns ribbon feed chute 56 to a position allowing feeding of ribbon 14 through head assembly 28. Because gear 160 meshes with gear 166, cams 158, 160 and 124, 126 rotate in unison. The cam surfaces are formed so that when cam 124 cause toggle 118 to close second gripper 42, cam 158 is causing three arm lever 138 to move knife 48 to cut tie ribbon 14.

DRIVE ASSEMBLY

As indicated above, a single drive assembly 200, through the use of clutches and gears, drives head assembly 28, gear mechanism 47 and positive drive wheels 62, 64. Each of these mechanisms are driven by a single electric motor 168.

As seen in FIG. 7, a frame 167 is positioned between mounting table 26 and a platform 169. A cross beam 171 is provided with frame 167 and acts in cooperation with frame 167 to support the shafts of drive assembly 100. An electric motor 168 is mounted on platform 169. Motor 168 is coupled to a drive shaft 172 through a flex coupling 170. Drive shaft 172 is rotatably mounted between opposed sides of frame 167. A bevel gear 174 is mounted on shaft 172. A shaft 177 is rotatably mounted between base plate 26 and cross beam 171. A bevel gear 176 is mounted at one end of shaft 177 and meshes with bevel gear 174 so as to be rotated thereby. A spur gear 180 is mounted on shaft 177 to rotate therewith. A clutch 182 is mounted on shaft 177 and rotates therewith. Clutch 182 is an electric clutch controlled by PLC 38. A sprocket 178 is operatively mounted on clutch 182 such that when clutch 182 is engaged sprocket 178 rotates therewith. A shaft 80 is also rotatably mounted between cross beam 171 and base plate 26. Additionally, as discussed above, shaft 88 extends through the base plate 26 and is coupled to gear 82 and a wheel 62 for rotation thereof. An electric clutch 179 is mounted on shaft 80. A spur gear 188 is mounted on clutch 179 and rotates when clutch 179 is engaged. Gear 188 constantly meshes with gear 180. A sprocket 190 is mounted on shaft 80 and is coupled to sprocket 178 by a chain 192, so that when either sprocket 178 or 190 is rotated, the other rotates.

Shaft 122 which extends to gear mechanism 147 is rotatably supported between cross beam 171 and base plate 26. As discussed above, rotation of shaft 122 drives the gears, cams and toggles of gear mechanism 47. A clutch 185 is mounted on shaft 122 to rotate therewith. A gear 181 is operatively mounted on clutch 185 and rotates therewith when clutch 185 is engaged. Clutch 185 is also an electric clutch, the operation of which is controlled by PLC 38.

The rotation of head assembly 28 is controlled by a drive belt 198 suspended between a first pulley 194 mounted on shaft 172 and a second pulley 196 mounted on a shaft 195 rotatably supported between opposed walls of frame 167. A gear 199 is fixedly supported on shaft 167 and meshes with gear 120 to cause rotation of head assembly 28. A clutch 195 is mounted on shaft 197 and pulley 196 is operatively coupled thereto so that shaft 197 does not rotate unless clutch 195 is engaged. Clutch 195 is also an electric clutch, the engagement of which is controlled by PLC 38.

Forward feeding of tie ribbon 14 is performed by the forward driving of positive drive wheels 62, 64. Forward driving of positive drive wheel 62, 64 occurs when clutch 179 is engaged so that the motion of gear 177 which is translated to the meshed gear 188 drives shaft 80. Shaft 80 causes positive drive wheel 62 and gear 82 to rotate. Gear 82 meshes with gear 74 causing gear 74 to rotate and wheel 64 along with it. During this operation, clutch 182 is disengaged as is clutch 185.

To reverse the drive of positive drive wheels 62, 64 to tension the tie ribbon 14, clutch 179 is disengaged.

Clutch 182 is engaged so that sprocket 178 is now driven with the rotation of shaft 177. Sprocket 178 is operatively coupled to sprocket 190 of chain 192 causing shaft 80 to rotate in the opposite direction it rotates when clutch 179 is engaged. During this reverse driving. clutch 185 is engaged so that shaft 122 begins to operate the grippers 40, 42.

In an exemplary embodiment, shaft 122 is rotated 120° to close first gripper 40. Toggle 102 is moved away from collar 94 in the direction of arrow I (FIG. 7) so as not to bear thereon. It is then rotated another 120° to close the second gripper. Toggle 118 is moved away from collar 114 in the direction of arrow K so as not to bear thereon. A last rotation of 120 opens both grippers 41, 42. Additionally, by providing a plurality of electrical clutches controlled by PLC 38, it is possible to continuously rotate shaft 172 in a single direction While obtaining a plurality of different motions.

OPERATION

The normal inoperative state of twist tie feed device 10 is first ring 32 in an elevated position. Ribbon 14 extends within ribbon feed chute 66 with its leading end protruding at knife edge 48 where it had been sheared in the previous tying operation of the machine. Twister head 44 is fixedly oriented by the meshing of gear 120 with gear 199. Slot 106 in twister head 44 is in alignment with channel 70 of ribbon feed chute 66 so that ribbon 14 when feeding from chute 66 can pass through slot 106 continuously. First gripper 40 is spaced away from gripper block 41 to provide an opening 104, while second gripper 42 is also spaced away from gripper block 41.

Product 12 is placed within slot 22 formed within base plate 26. The operator then initiates operation by activating motor 168 which provides the rotational drive for the other system components. Operation is automatic thereafter until tying is completed and conditions are restored prior to the next cycle.

After activation of the machine, solenoid 51 is deactivated allowing spring 69 to pull lever arm 54 and cross link 71 causing first ring 32 and second ring 30 to both be moved from its open position FIG. 8 to the closed position shown in FIGS. 1, 7 to form a loop. As stated, guide channels 34 and first and second rings 30, 32 come together to form a continuous channel in the form of a circle perpendicular to a properly placed bundle 12.

Once the ring is closed, PLC 38 engages clutch 179. Accordingly, the rotation of gear 180 continuously transferred to gear 188 through meshing is now transferred to shaft 80. Shaft 80 drives feed wheel 62 in the direction of arrow B and positive drive wheel 64 in the direction of arrow C feeding tie ribbon 14 in the direction of arrow D (FIG. 1). Because both drive wheel 62, 64 are positively driven, they cause pivot arm 204 to pivot tensioning tie ribbon 14 along the feed path and overcoming the inertia of supply drum 36 causing supply drum 36 to rotate in the direction of arrow A feeding a continuous supply of tie ribbon 14 towards the ring. Spring 84 biasing wheel 64 towards wheel 62 provides frictional engagement with tie ribbon 14, the tie ribbon 14 being compressed between feed wheels 62, 64 to be fed in the indicated directions. However, because of the meshing of gears 74, 82 power drive wheel 62, 64 are synchronously driven and there is no net shearing effect on ribbon 14.

As illustrated in FIGS. 1, 1*a*, 2 and 8, tie ribbon 14 feeds through ribbon feed chute 66 through slot 106 between second gripper 42 and twister head 44 to enter channel 34 in first ring 32, moving around the circle until the leading end of tie ribbon 14 enters slot 104 between gripper 40 and gripper 41.

Forward feeding of tie ribbon 14, as described, ends when PLC 38 counts a predetermined number of rotations of either power drive wheel 62 or 64 corresponding to a complete feed of tie ribbon 14 about channel 34 and into head assembly 28. PLC 38 monitors the number of revolutions of the drive wheels by utilizing a proximity detector 212 (FIG. 11) or the like well known in the art for counting the number of turns of a mechanical device. Once PLC 38 has counted the predetermined number of turns, it causes the ring to be opened and disengages clutch 179 stopping forward feeding of tie ribbon 14 and engages clutch 185. Cam 126 is rotated 120° causing toggle 102 to rotate about pivot pin 136 to the position shown in phantom allowing spring 100 to bias collar 94 backwards closing first gripper 40. Tie ribbon 14 is securely held between first gripper 40 and gripper block 41.

Once gripper 40 has been closed, clutch 185 is disengaged and clutch 182 is engaged. Engaging clutch 182 translates the rotation of shaft 177 to sprocket 178. The rotation of sprocket 178 is transmitted to sprocket 190 through chain 192 causing shaft 80 to rotate in a reverse direction. Positive drive wheels 62, 64 rotate in a reverse direction feeding ribbon 14 from head assembly 28 in the direction of arrow F (FIG. 1). As seen in FIGS. 1 and 8, the loop of tie ribbon 14 is reduced in diameter by drawing back the ribbon 14 between second gripper 42 and gripper block 41, back through chute 66 and between feed wheel 62, 64.

This reverse feeding of the tie ribbon represented as 14' continues until the tension of the tie ribbon causes bundle 12 to contact tension bar 53. Ribbon 14 pulls bundle 12 against tension bar 53 in the direction of arrow P (FIG. 1) moving tension bar 53 towards microswitch 60. Simultaneously pulley 24 pivots to its original position braking supply drum 36. When the tension has reached the predetermined amount, microswitch 60 is activated signaling the PLC to disengage clutch 182 stopping the reverse feeding and to engage clutch 185. The amount of tension may be varied by interchanging spring 57 with other springs of varying biasing forces. By engaging clutch 185, the rotational motion of shaft 177 is transmitted to gear 181 through gear 180 which in turn causes shaft 122 to begin rotating again. As shaft 122 rotates through a second 120°, cam 124 causes toggle 118 to rotate about pivot pin 128 to the position shown in phantom in FIG. 3. This releases collar 114 allowing spring 116 to bias gripper head 108 towards gripper block 41 capturing tie ribbon 14 therebetween. Accordingly, gripper heads 40, 42 and tie ribbon 14 are now positioned as shown in FIG. 7.

Gear 164 positioned on shaft 160 meshes with gear 166 on shaft 122. Accordingly, simultaneous with the rotation of shaft 122, shaft 160 has also been caused to rotate. During the second 120° rotation of shaft 122, cam 158 acts upon cam follower 156 to cause three arm lever 138 to rotate about pivot pin 140 causing knife 48 to move in the direction of arrow G (FIG. 6*a*). Knife 48 shears tie ribbon 14 against block 87. Accordingly, first gripper 40 and second gripper 42 contained within twister head 44 are free to rotate in unison about a common axis.

Once PLC 38 has determined through a proximity detector 210 or the like, the rotation of shaft 122, PLC 38 disengages clutch 185 and engages clutch 195. Engaging clutch 195 causes shaft 197 to rotate. The rotation of shaft 197 is translated to gear 120 through gear 199. Rotation of gear 120 causes twister head 28 to rotate, causing first gripper 40 and second gripper 41 to rotate relative to bundle 12. The rotation of grippers 40 and 42 twist tie ribbon 14 upon itself in the direction of arrow J (FIG. 9) forming a twist indicated at 20. Twister head 44 performs three or four rotations until twist head 44 is returned to either its original position or a position 180° rotated from that position. Once PLC 38 has determined through the use of proximity a detector 214 located on rod 110, that the required number of revolutions has been completed, it disengages clutch 195.

The product has now been tied with ribbon 14 and separated from the supply of tie ribbon 14. Clutch 185 is now reengaged causing shaft 122 to complete its full rotational motion. As shaft 122 rotates, cam 124 contacts cam follower 130 causing toggle 118 to return to the position shown in FIG. 3, opening second jaw 42. Cam 162 causes toggle 102 to pivot about pivot pin 136 to return to the position shown in dark lines FIG. 3 opening first gripper 40. Simultaneously, cam 162 contacts cam follower 150 in a manner causing three arm lever 138 to rotate about pivot pin 140 returning ribbon feed chute 66 to its original feed position. The tied product is now easily removed from the work space. Thus, twist tie feed device 10 is in a condition to accept another product 12 to have a ribbon 14 tied there around. Device 10 may activated for a continuous repetitive operation.

By providing a twist tie feed device utilizing two positive drive wheels, it is possible to feed tie ribbon directly from the supply without the use of an accumulator. Additionally, by feeding the tie ribbon about a circular ring, a more efficient tie which is perpendicular to the bundle being tied may be obtained. Providing a tension bar between the twist head and the bundle being tied, the tension bar determining when feedback of the ribbon is to be terminated, not only protects the twist head assembly from coming in too close a proximity to the bundle, but regulates the tightness of the wrap about the bundle to prevent damage to the bundle. By providing a plurality of cams and gears for opening and closing the gripper jaws, it becomes possible to not only control the timing and sequence of the opening and closing of the jaws, but allows for the cutting of the tie ribbon at the same time while utilizing a single forward rotating drive shaft. Furthermore, because there is no need for an accumulator, the device may be made more compact utilizing less components and provide higher reliability as there are less components which may malfunction. Lastly, by utilizing a plurality of electric clutches, and a simplified gearing mechanism, a PLC may be utilized to control the timing of each of the component systems without the need for a complex gearing and camming timing system.

It will thus be seen that the objects set forth above, among those made apparent from the preceding description, are efficiently attained and, since certain changes may be made in the above construction without departing from the spirit and the scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A twist tie feed device for twisting together the ends of a tie ribbon encircling an article which is positioned therein for tying comprising:

a base plate;

twist head assembly means rotatably mounted on said base plate for receiving and grasping a first end of said tie ribbon and a second end of said encircling tie ribbon and rotating about itself to twist said tie ribbon about the article forming a tie extending away from said article, said twist head assembly means including a gripper block, first gripper means adjacent to the position at which an article is to be placed for tying, the first gripper means being movable relative to the gripper block so as to be spaced apart therefrom in a first state and drawn thereto in a second state to clamp one end of a tie ribbon therebetween; second gripper means adjacent to a position at which an article is to be placed for tying, the second gripper means being movable relative to the gripper block so as to be spaced apart therefrom in a first state and drawn thereto in a second state to clamp a second end of a tie ribbon therebetween so that said first end of said tie ribbon substantially overlaps said second end of said tie ribbon; a housing rotatably mounted on said base plate, said first gripper means and said second gripper means being disposed in said housing to rotate therewith; and rotation means coupled to said housing for rotating said housing, first gripper means, and second gripper means in unison about a common axis so that when the first gripper means and second gripper means are in the second state, the clamped ends of the tie ribbon will be twisted relative to each other, said rotation means being coupled to said drive means;

positive drive means mounted on said base plate along the feed path of the tie ribbon for selectively feeding said ribbon in one of a first direction toward said twist head assembly means and in a second direction away from said twist head assembly means, said tie ribbon having a first side and a second side, said positive drive means contacting said tie ribbon at said first side and said second side to apply a positive drive force to said first side and second side of said tie ribbon as it passes through said positive drive means; and drive assembly means mounted on said base plate operatively coupled to said twist head assembly and said positive drive means for driving said positive drive means and said twist head assembly.

2. The twist tie feed device of claim 1, wherein said positive drive means includes a first drive wheel disposed to contact said first side of said tie ribbon, said first drive wheel being coupled to said drive means, and a second drive wheel contacting said second side of said tie ribbon and being operatively coupled to said first wheel so that rotation of said first drive wheel causes rotation of said second drive wheel, rotation of said first drive wheel and second drive wheel feeding said tie ribbon in said first and second directions.

3. The twist tie feed device of claim 2, further comprising biasing means for biasing said second drive wheel toward said first wheel such that said positive drive means engages said first and second sides of said tie ribbon.

4. The twist tie feed device of claim 2, further including a shaft coupled to said drive assembly means, said first drive wheel being coupled to said shaft, a first gear mounted about said shaft, a second shaft rotatably mounted on said base plate, said second drive wheel being mounted on a second shaft rotatably mounted on said base plate, a second gear mounted on said second shaft and meshing with said first gear so that first drive wheel and said second drive wheel synchronously rotate.

5. The twist tie feed device of claim 1, further comprising control means for causing said positive drive means to feed said tie ribbon in said first direction and second direction, causing said twist head assembly means to twist the tie ribbon and determining when said positive drive means is to feed said tie ribbon in said first direction, feed said tie ribbon in said second direction and when said twist head assembly is to twist said tie ribbon.

6. The twist tie feed device of claim 5, wherein said control means is a PLC.

7. The twist tie feed device of claim 1, wherein said housing is a cylinder and said rotation means includes a gear mounted about the periphery of the cylinder.

8. The twist tie feed device of claim 1, further comprising gearing means operatively coupled to said feed assembly means and said drive means for successively positioning the first gripper means and the second gripper means in their second states.

9. The twist tie feed device of claim 8, further comprising a ribbon feed chute pivotably mounted on the base plate, the feed chute having an exit for feeding the tie ribbon from the positive drive means to the twist head assembly means, knife means integrally formed with said ribbon feed chute for cutting the tie ribbon at the exit simultaneously with the grasping of the second end of the tie ribbon, said ribbon feed chute pivoting to cause the ribbon to cut, and wherein said gearing means is operatively coupled to said ribbon feed chute and said feed chute to pivot simultaneously with the grasping of the second end of the ribbon.

10. The twist tie feed device of claim 1, further comprising a ring mounted adjacent said twist head assembly means for guiding said twist tie ribbon in a path to encircle a product, the path formed by the ring being a circular path substantially perpendicular to an article which is positioned for tying.

11. The twist tie feed device of claim 1, further comprising control means for controlling the sequential and simultaneous operation of the drive assembly means, positive drive means and twist head assembly means.

12. The twist tie feed device of claim 1, further comprising tie ribbon tensioning means for controlling the tension at which the tie ribbon encircles the article positioned therein.

13. The twist tie feed device of claim 12, wherein said ribbon tensioning means controls the tension of said tie ribbon by controlling the amount of ribbon driven in said second direction away from said twist head assembly means by said positive drive means.

14. The twist tie feed device of claim 13, further comprising control means for causing said positive drive means to feed said tie ribbon in said first direction and second direction, and tension determining means contacted by said article to determine the tension at which said tie ribbon encircles said article, said tension determining means providing an output to said control means when said ribbon encircles said article with a predetermined tension to stop the operation of said positive drive means from feeding said tie ribbon in said second direction.

15. A twist tie feed device for twisting together the ends of a tie ribbon encircling an article which is positioned therein for tying comprising:

a base plate;

twist head assembly means rotatably mounted on said base plate for receiving and grasping a first end of said tie ribbon and a second end of said encircling tie ribbon and rotating about itself to twist said tie ribbon about the article; said twist head assembly means including a gripper block, first gripper means adjacent to the position at which an article is to be placed for tying, the first gripper means being movable relative to the gripper block so as to be spaced apart therefrom in a first state and drawn thereto in a second state to clamp one end of a tie ribbon therebetween; second gripper means adjacent to a position at which an article is to be placed for tying, the second gripper means being movable relative to the gripper block so as to be spaced apart therefrom in a first state and drawing thereto in a second state to clamp a second end of a tie ribbon therebetween; a housing rotatably mounted on said base plate, said first gripper means and said second gripper means being disposed in said housing to rotate therewith; said housing being a cylinder, said first gripper means including a first rod and a second rod slidably mounted within said cylinder, said rods having a first end and a second end, a gripper head mounted on said first end and a collar mounted at said second end of said rods, a spring for biasing the first gripper means into the second state, and said second gripper means including a third rod having a first end and a second end slidably mounted in said cylinder and a second gripper head mounted at one end of said third rod and a second collar mounted on said second end of said third rod and a spring mounted within said cylinder for biasing said second gripper into the second state;

rotation means coupled to said housing for rotating said housing, first gripper means, and second gripper means in unison about a common axis so that when the first gripper means and second gripper means are in the second state, the clamped ends of the tie ribbon will be twisted relative to each other, said rotation means being coupled to said drive means;

positive drive means mounted on said base plate along the feed path of the tie ribbon for selectively feeding said ribbon in one of a first direction toward said twist head assembly means and in a second direction away from said twist head assembly means, said tie ribbon having a first side and a second dside, said positive drive means contacting said tie ribbon at said first side and said second side to apply a positive drive force to said tie ribbon as it passes through said positive drive means; and drive assembly means mounted on said base plate operatively coupled to said twist head assembly and said positive drive means for driving said positive drive means and said twist head assembly.

16. The twist tie feed device of claim 15, further comprising gearing means operatively coupled to said head assembly means and said drive means for successively positioning the first gripper means and the second gripper means in their second states, said gearing means including a rotatable shaft, said shaft being operatively coupled to the drive assembly means, a first cam and a second cam being mounted on said shaft to rotate therewith, a first toggle contacting said first collar and the periphery of said first cam for moving said first gripper into said first state in response to the rotation of said first cam, a second toggle contacting said second collar and the periphery of said second cam for moving said second gripper into said second state in response to the rotation of said second cam.

17. The twist tie feed device of claim 16, wherein said shaft rotates 360° in one direction and during a rotation of a first 120°, the first spring biases the first gripper to the second state, during a rotation of a second 120°, the second spring biases the second gripper into the second state and during a rotation of a third 120° of the shaft said first toggle returns the first gripper means to the first state and the second toggle returns the second gripper means to the first state.

18. The twist tie feed device of claim 17, further comprising control means for determining the amount of rotation performed by said shaft and causing a sequential operation of said first toggle and second toggle in response thereto.

19. The twist tie feed device of claim 18, wherein said control means is a PLC.

20. The ribbon feed device of claim 16, further comprising a ribbon feed chute pivotably mounted on the base plate, the feed chute having an exit for feeding the tie ribbon from the positive drive means to the twist head assembly means, knife means integrally formed with said ribbon feed chute for cutting the tie ribbon at the exit simultaneously with the grasping of the second end of the tie ribbon, said ribbon feed chute pivoting to cause the ribbon to cut, and wherein said gearing means is operatively coupled to said ribbon feed chute and causes said feed chute to pivot simultaneously with the grasping of the second end of the ribbon, a gear mounted on said shaft, a second shaft rotatably mounted on said base plate, a third cam and a fourth cam mounted on said shaft to rotate therewith, a second gear mounted on said second shaft and meshing with said first gear to rotate synchronously therewith, a lever, rotatably mounted on said base plate, said lever being coupled to said ribbon feed chute and contacting the respective peripheries of said third cam and fourth cam and rotating a response thereto to pivot said ribbon feed chute.

21. A twist tie feed device for twisting together the ends of a tie ribbon encircling an article which is positioned therein for tying comprising:

a base plate;

twist head assembly means rotatably mounted on said base plate for receiving and grasping a first end of said tie ribbon and a second end of said encircling tie ribbon and rotating about itself to twist said tie ribbon about the article forming a tie extending away from said article;

positive drive means mounted on said base plate along the feed path of the tie ribbon for selectively feeding said ribbon in one of a first direction toward said twist head assembly means and in a second direction away from said twist head assembly means, said tie ribbon having a first side and a second side, said positive drive means contacting said tie ribbon at said first side and said second side to apply a positive drive force to said first side and second side of said tie ribbon as it passes through said positive drive means; and drive assembly means mounted on said base plate operatively coupled to said twist head assembly and said positive drive means for driving said positive drive means and said twist head assembly; and a ribbon feed chute pivotably mounted on the base plate, the feed chute having an exit for feeding the tie ribbon from the positive drive means to the twist head assembly means, knife means integrally formed with said ribbon feed chute for cutting the tie ribbon at the exit simultaneously with the grasping of the second end of the tie ribbon, said ribbon feed chute pivoting to cause the ribbon to be cut.

22. A twist tie feed device for twisting together the ends of a tie ribbon encircling an article which is positioned therein for tying comprising:

a base plate;

twist head assembly means rotatably mounted on said base plate for receiving and grasping a first end of said tie ribbon and a second end of said encircling tie ribbon and rotating about itself to twist said tie ribbon about the article forming a tie extending away from said article;

positive drive means mounted on said base plate along the feed path of the tie ribbon for selectively feeding said ribbon in one of a first direction toward said twist head assembly means and in a second direction away from said twist head assembly means, said tie ribbon having a first side and a second side, said positive drive means contacting said tie ribbon at said first side and said second side to apply a positive drive force to said first side and second side of said tie ribbon as it passes through said positive drive means; and drive assembly means mounted on said base plate operatively coupled to said twist head assembly and said positive drive means for driving said positive drive means and said twist head assembly;

said drive means including an electric motor and a drive shaft coupled thereto, said drive shaft continuously rotating in a single direction during operation of the twist tie feed device.

23. A twist tie feed device for twisting together the ends of a tie ribbon and circling an article which is positioned therein for tying comprising:

a base plate;

twist head assembly means rotatably mounted on said base plate for receiving and grasping a first end of said encircling tie ribbon and a second end of said tie ribbon and rotating about itself to twist said tie ribbon about the article forming a tie extending away from said article; the twist head assembly including a gripper block, first gripper means adjacent to the position at which an article is to be placed for tying, the first gripper means being movable relative to the gripper block so as to be spaced apart therefrom in a first state and drawn thereto in a second state to clamp one end of a tie ribbon therebetween; second gripper means adjacent to a position at which an article is to be placed for tying, the second gripper means being movable relative to the gripper block so as to be spaced apart therefrom in a first state and drawing thereto in a second state to clamp a second end of a tie ribbon therebetween; a housing rotatably mounted on said base plate, said first gripper means and said second gripper means being disposed in said housing to rotate therewith; and rotation means coupled to said housing for rotating said housing, first gripper means, and second gripper means in unison about a common axis so that when the first gripper means and second gripper means are in the second state, the clamped ends of the tie ribbon will be twisted relative to each other, said rotation means being coupled to said drive means;

positive drive means mounted on said base plate along the feed path of the tie ribbon for selectively feeding said ribbon in one of a first direction toward said twist head assembly means and in a second direction away from said twist head assembly means, said tie ribbon having a first side and a second side, said positive drive means contacting said tie ribbon at said first side and said second side to apply a positive drive force to said tie ribbon as it passes through said positive drive means; said positive drive means including a first drive wheel disposed to contact said first side of said tie ribbon, said first drive wheel being coupled to said drive means, and a second drive wheel contacting said second side of said tie ribbon and being operatively coupled to said first wheel so that rotation of said first wheel causes rotation of said second wheel to provide a positive drive force to said first side and said second side of said tie ribbon, rotation of said first wheel and second wheel feeding said tie ribbon in said first and second directions;

drive assembly means mounted on said base plate operatively coupled to said twist head assembly and said positive drive means for driving said positive drive means and said twist head assembly;

gearing means operatively coupled to said head assembly means and said drive means for successively positioning the first gripper means and the second gripper means in their second states; and a ribbon feed chute pivotably mounted on the base plate, the feed chute having an exit for feeding the tie ribbon from the positive drive means to the twist head assembly means, knife means integrally formed with said ribbon feed chute for cutting the tie ribbon at the exit simultaneously with the grasping of the second end of the tie ribbon, said ribbon feed chute pivoting to cause the ribbon to cut.

24. The twist tie feed device of claim 23, wherein said gearing means is operatively coupled to said ribbon feed chute and causes said feed chute to pivot simultaneously with the grasping of the second end of the ribbon.

25. The twist tie feed device of claim 24, further comprising control means for controlling the simultaneous and sequential operation of the positive drive means, gearing means, twist head assembly means and drive assembly means.

26. The twist tie feed device of claim 25, wherein said control means counts a number of turns said first drive wheel rotates to drive said feed wheel to feed the tie ribbon in the first direction and stopping the positive drive means once a predetermined number of rotations has occurred and then driving said drive wheels to pivot in a direction to feed the drive wheels in a second direction.

27. The twist tie feed device of claim 25, wherein said control means causes said drive assembly means to rotate said twist head assembly, counts the number of rotations of said twist head assembly and terminates the rotation of the twist head once a predetermined number of twists have occurred.

28. The twist tie feed device of claim 25, wherein said gearing means is coupled to said drive assembly means by a drive shaft, said drive shaft rotating 360° in a single direction during operation and said control means causing said drive shaft to rotate in discrete 120° intervals.

29. The twist tie feed device of claim 23, further comprising tie ribbon tensioning means for controlling the tension at which the tie ribbon encircles the article positioned therein.

30. The twist tie feed device of claim 29, wherein said ribbon tensioning means controls the tension of said tie ribbon by controlling the amount of ribbon driven in said second direction away from said twist head assembly means by said positive drive means.

31. The twist tie feed device of claim 23, further comprising control means for causing said positive drive means to feed said tie ribbon in said first direction and second direction, and tension determining means contacted by said article to determine the tension at which said tie ribbon encircles said article, said tension determining means providing an output to said control means when said ribbon encircles said article with a predetermined tension to stop the operation of said positive drive means from feeding said tie ribbon in said second direction.

* * * * *